US010578106B2

(12) United States Patent
Cho et al.

(10) Patent No.: US 10,578,106 B2
(45) Date of Patent: Mar. 3, 2020

(54) COMPRESSOR

(71) Applicant: SAMSUNG ELECTRONICS CO., LTD., Suwon-si, Gyeonggi-do (KR)

(72) Inventors: Yang Hee Cho, Yongin-si (KR); Moo Seong Bae, Osan-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 615 days.

(21) Appl. No.: 14/918,122

(22) Filed: Oct. 20, 2015

(65) Prior Publication Data

US 2016/0169227 A1 Jun. 16, 2016

(30) Foreign Application Priority Data

Dec. 12, 2014 (KR) ..... 10-2014-0179230

(51) Int. Cl.

| | |
|---|---|
| ***F01C 1/02*** | (2006.01) |
| ***F01C 1/063*** | (2006.01) |
| ***F03C 2/02*** | (2006.01) |
| ***F04C 18/063*** | (2006.01) |
| ***F01C 20/12*** | (2006.01) |
| ***F04C 14/18*** | (2006.01) |

(Continued)

(52) U.S. Cl.

CPC ..... *F04C 28/18* (2013.01); *F04C 18/0215* (2013.01); *F04C 18/0253* (2013.01); *F04C 18/0261* (2013.01); *F04C 28/12* (2013.01); *F04C 28/26* (2013.01)

(58) Field of Classification Search

CPC .. F04C 28/26; F04C 18/0261; F04C 18/0253; F04C 18/0215; F04C 28/18

USPC ..... 418/55.1–55.6, 24, 26, 27, 180, 270, 57

See application file for complete search history.

(56) References Cited

U.S. PATENT DOCUMENTS 4,846,633 A * 7/1989 Suzuki ..... F04C 28/16 417/310
5,722,257 A * 3/1998 Ishii ..... F04C 29/0035 418/55.5

(Continued)

FOREIGN PATENT DOCUMENTS

| | | |
|---|---|---|
| CN | 1105243 | 4/2003 |
| CN | 1276180 | 9/2006 |

(Continued)

OTHER PUBLICATIONS

International Search Report dated Feb. 29, 2016 from International Patent Application No. PCT/KR2015/012051, 3 pages.

(Continued)

*Primary Examiner* — Deming Wan
(74) *Attorney, Agent, or Firm* — Staas & Halsey LLP

(57) ABSTRACT

A variable capacity scroll compressor includes a fixed scroll. The fixed scroll of the compressor includes a bypass flow path configured to connect a suction unit to a compression unit, a cylinder space provided on the bypass flow path, and an on/off valve disposed to be movable back and forth in the cylinder space to open/close the bypass flow path according to a difference between a discharge pressure of the discharge unit and a suction pressure of the suction unit. Thus a capacity of the compressor may be reduced by connecting the suction unit to the compression unit under a low load condition in which a difference between a discharge pressure and a suction pressure is relatively less.

17 Claims, 16 Drawing Sheets

(51) Int. Cl.

| | |
|---|---|
| ***F04C 28/18*** | (2006.01) |
| ***F04C 28/02*** | (2006.01) |
| ***F04C 18/02*** | (2006.01) |
| ***F04C 28/26*** | (2006.01) |
| ***F04C 28/12*** | (2006.01) |

(56) References Cited

U.S. PATENT DOCUMENTS

| | | | | |
|---|---|---|---|---|
| 5,873,707 | A * | 2/1999 | Kikuchi | F04C 28/12 417/309 |
| 6,139,287 | A * | 10/2000 | Kuroiwa | F04C 28/26 417/299 |
| 6,164,940 | A * | 12/2000 | Terauchi | F04C 28/16 418/14 |
| 6,893,229 | B2 | 5/2005 | Choi et al. | |
| 7,381,037 | B2 | 6/2008 | Kim et al. | |
| 8,177,522 | B2 * | 5/2012 | Kiem | F04C 18/0215 417/213 |
| 2004/0126259 | A1 | 7/2004 | Choi et al. | |
| 2004/0197204 | A1 | 10/2004 | Yamanouchi et al. | |
| 2009/0196781 | A1 | 8/2009 | Kiem et al. | |
| 2009/0297379 | A1 | 12/2009 | Stover et al. | |
| 2012/0009076 | A1 * | 1/2012 | Kim | F04C 18/0215 418/55.1 |
| 2014/0056727 | A1 | 2/2014 | Koyama et al. | |

FOREIGN PATENT DOCUMENTS

| | | |
|---|---|---|
| CN | 101498302 | 8/2009 |
| CN | 102089525 | 6/2011 |
| CN | 102330677 | 1/2012 |
| EP | 2085617 | 8/2009 |
| JP | 5-231353 | 9/1993 |
| JP | 5-332263 | 12/1993 |
| JP | 6-307357 | 11/1994 |
| JP | 7-12065 | 1/1995 |
| JP | 7-77177 | 3/1995 |
| JP | 7-167075 | 7/1995 |
| JP | 7-189926 | 7/1995 |
| JP | 7-279679 | 10/1995 |
| JP | 08-163999 | 6/1996 |
| JP | 8-313080 | 11/1996 |
| JP | 11-182460 | 7/1999 |
| JP | 2000-018181 | 1/2000 |
| JP | 2000-104684 | 4/2000 |
| JP | 2000-356194 | 12/2000 |
| JP | 2001-066000 | 3/2001 |
| JP | 2004-084654 | 3/2004 |
| JP | 2004-138005 | 5/2004 |
| JP | 2004-138006 | 5/2004 |
| JP | 2004-156532 | 6/2004 |
| JP | 2004-211567 | 7/2004 |
| JP | 2006-132520 | 5/2006 |
| JP | 2006-138305 | 6/2006 |
| JP | 2006-177335 | 7/2006 |
| JP | 2006-214430 | 8/2006 |
| JP | 2006-291782 | 10/2006 |
| JP | 2010-163951 | 7/2010 |
| JP | 2012-026610 | 2/2012 |
| JP | 2013-130133 | 7/2013 |
| JP | 2014-001690 | 1/2014 |
| KR | 10-1991-0004936 | 3/1991 |
| KR | 10-1992-0002935 | 2/1992 |
| KR | 10-2003-0075697 | 9/2003 |
| KR | 10-2004-0019631 | 3/2004 |
| KR | 10-2004-0028025 | 4/2004 |
| KR | 10-2004-0035177 | 4/2004 |
| KR | 10-2004-0091361 | 10/2004 |
| KR | 10-2004-0091362 | 10/2004 |
| KR | 10-2005-0012633 | 2/2005 |
| KR | 10-2005-0012634 | 2/2005 |
| KR | 10-2005-0012636 | 2/2005 |
| KR | 10-2005-0083476 | 8/2005 |
| KR | 10-2005-0095246 | 9/2005 |
| KR | 10-0608664 | 9/2005 |
| KR | 10-2005-0097339 | 10/2005 |
| KR | 10-2006-0030305 | 4/2006 |
| KR | 10-0575694 | 4/2006 |
| KR | 10-0575704 | 4/2006 |
| KR | 10-0575709 | 4/2006 |
| KR | 10-2006-0040163 | 5/2006 |
| KR | 10-0578662 | 5/2006 |
| KR | 10-0585811 | 5/2006 |
| KR | 10-2006-0072736 | 6/2006 |
| KR | 10-0595580 | 6/2006 |
| KR | 10-0614231 | 8/2006 |
| KR | 10-2006-0104444 | 10/2006 |
| KR | 10-2007-0078655 | 8/2007 |
| KR | 10-2009-0043989 | 5/2009 |
| KR | 10-2009-0071089 | 7/2009 |
| KR | 10-2009-0084298 | 8/2009 |
| KR | 10-2009-0089726 | 8/2009 |
| KR | 10-2009-0095381 | 9/2009 |
| KR | 10-2009-0100999 | 9/2009 |
| KR | 10-2009-0103580 | 10/2009 |
| KR | 10-2010-0017008 | 2/2010 |
| KR | 10-2010-0081814 | 7/2010 |
| KR | 10-2010-0081819 | 7/2010 |
| KR | 10-2010-0097022 | 9/2010 |
| KR | 10-2011-0009257 | 1/2011 |
| KR | 10-2011-0098361 | 9/2011 |
| KR | 10-2012-0006398 | 1/2012 |
| KR | 10-2014-0012858 | 4/2014 |
| RU | 2472035 | 1/2013 |

OTHER PUBLICATIONS

Extended European Search Report dated Nov. 24, 2017 in European Patent Application No. 15868613.9.

Russian Office Action dated Mar. 14, 2018 in Russian Patent Application No. 2017120295/06(035237).

Chinese Office Action dated Jul. 19, 2018 in Chinese Patent Application No. 201510920861.6.

Russian Decision on Grant dated Jul. 17, 2018 in Russian Patent Application No. 2017120295/06.

European Communication dated Oct. 9, 2018 in European Patent Application No. 15868613.9.

Chinese Office Action dated Apr. 2, 2019 in Chinese Patent Application No. 201510920861.6.

European Communication under Rule 71(3) dated Jun. 14, 2019 in European Patent Application No. 15868613.9.

Indian Office Action dated May 17, 2019 in Indian Patent Application No. 201717022575.

Chinese Office Action dated Oct. 9, 2019 in Chinese Patent Application No. 201510920861.6.

* cited by examiner $$Pd - Ps < Pr$$

Pd − Ps > Pr $Pd - Ps < Pr$

Pd − Ps > Pr $Pd - Ps < Pr$ $Pd - Ps > Pr$

Pd − Ps < Pr

Pd − Ps > Pr

COMPRESSOR

CROSS-REFERENCE TO RELATED APPLICATIONS

This application claims the priority benefit of Korean Patent Application No. 10-2014-0179230, filed on Dec. 12, 2014 in the Korean Intellectual Property Office, the disclosure of which is incorporated herein by reference.

BACKGROUND

1. Field

Embodiments of the disclosure relate to a variable capacity scroll compressor.

2. Description of the Related Art

In general, a scroll compressor refers to an apparatus to compress refrigerant by a relative motion by combining a fixed scroll and an orbiting scroll both of which have a wrap in a shape of a screw. The scroll compressor is more efficient, has less vibration, is quieter, compact, and lighter in comparison with a reciprocating compressor and a rotary compressor, and thus the scroll compressor is widely used for refrigeration cycle apparatuses.

A compressor of an air conditioner is typically configured to have a cooling capacity in consideration with the maximum cooling capacity. However, the cooling capacity may vary according to an ambient temperature and the compressor may be often driven when a cooling load is lower than the maximum cooling capacity.

As mentioned above, when the compressor is driven in a state in which a load is lower than the maximum cooling load, a cooling capacity of the compressor may be larger than a load and thus the compressor may be required to perform on/off driving properly. Therefore the consumption of electricity may be increased and the efficiency may be reduced.

To relieve those difficulties, a compressor having a variable capacity structure may be used. The variable capacity structure of the compressor may include a structure configured to adjust a torque by using an inverter motor and a structure configured to bypass refrigerant of a discharge unit and a suction unit. However, the structure having an inverter motor may have limitations in reducing a speed due to a leakage and a difficulty in supplying oil at a low speed rotation, and the bypass structure may have a complexity in assembling and controlling, and thus a reliability may be reduced.

SUMMARY

Therefore, it is an aspect of the disclosure to provide a compressor capable of varying the capacity of compressed refrigerant by connecting a compression unit to a suction unit when a difference between a discharge pressure and a suction pressure is less than a predetermined pressure Additional aspects of the disclosure will be set forth in part in the description which follows and, in part, will be apparent from the description, or may be learned by practice of the disclosure.

In accordance with an aspect of the disclosure, a compressor may include a case, a fixed scroll fixed to the inside of the case, an orbiting scroll provided to revolve on or move about the fixed scroll, a compression unit formed by the fixed scroll and the orbiting scroll and configured to have a volume that is reduced while moving toward the center of the fixed scroll and the orbiting scroll according to the revolution (movement) of the orbiting scroll, a suction unit configured to suction refrigerant to be delivered to the compression unit, and a discharge unit to which refrigerant compressed by the compression unit is discharged. The fixed scroll may include a bypass flow path configured to connect the suction unit to the compression unit, a cylinder space provided on the bypass flow path, and an on/off valve disposed to be movable back and forth in the cylinder space to open/close the bypass flow path according to a difference between a discharge pressure of the discharge unit and a suction pressure of the suction unit.

The on/off valve may open the bypass flow path when a difference between a discharge pressure of the discharge unit and a suction pressure of the suction unit is less than a predetermined pressure, and may close the bypass flow path when a difference between a discharge pressure of the discharge unit and a suction pressure of the suction unit is larger than a predetermined pressure.

The compressor may include an elastic member disposed in the cylinder space to bias the on/off valve in an elastic manner so that the on/off valve may open the bypass flow path.

The elastic member may include a coil spring.

The fixed scroll may include an elastic member supporting unit configured to support one end of the elastic member.

One end of the elastic member may be supported by the elastic member supporting unit, and the other end of the elastic member may be supported by the on/off valve.

The bypass flow path may include a suction unit flow path configured to connect the suction unit to the cylinder space, and a compression unit flow path configured to connect the compression unit to the cylinder space.

The fixed scroll may include a discharge unit flow path configured to connect the discharge unit to the cylinder space.

The on/off valve may include a first compression unit compressed by a suction pressure of the suction unit, a second compression unit compressed by a discharge pressure of the discharge unit and formed on an opposite side to the first compression unit in a moving direction of the on/off valve, and an opening unit configured to open/close the bypass flow path.

The fixed scroll may include a plate unit having a wrap unit extended toward a lower side, and the cylinder space may be formed inside the plate unit.

The fixed scroll may include a plate unit having a wrap unit extended toward a lower side, and a valve housing coupled to an upper surface of the plate unit, wherein the cylinder space may be formed inside the valve housing.

The valve housing may include a bottom housing coupled to an upper surface of the plate unit and configured to form a part of the cylinder space, an intermediate housing coupled to the bottom housing and configured to form the rest of the cylinder space, and a cover housing coupled to the intermediate housing and provided with a discharge unit flow path configured to connect the cylinder space to the discharge unit.

The fixed scroll may include a plate unit having a wrap unit extended toward a lower side, a valve housing coupled to an upper surface of the plate unit, wherein a part of the cylinder space may be formed in the plate unit and the rest of the cylinder space may be formed inside the valve housing.

The on/off valve may have a cylindrical shape.

The on/off valve may have a spherical shape.

The on/off valve may be provided to be movable back and forth in a vertical direction in the cylinder space.

The on/off valve may be provided to be movable back and forth in a horizontal direction in the cylinder space.

In accordance with an aspect of the disclosure, a compressor may include a case, a fixed scroll fixed to the inside of the case, an orbiting scroll provided to revolve on or move about the fixed scroll and configured to form a suction unit and a compression unit with the fixed scroll, a discharge unit to which refrigerant compressed by the compression unit is discharged, a cylinder space provided in the fixed scroll, a suction unit flow path configured to connect the cylinder space to the suction unit, a compression unit flow path configured to connect the cylinder space to the compression unit, a discharge unit flow path configured to connect the cylinder space to the discharge unit, an on/off valve disposed to be movable back and forth in the cylinder space and configured to connect/disconnect the suction unit flow path and the compression unit flow path according to a difference between a discharge pressure of the discharge unit and a suction pressure of the suction unit, and an elastic member provided in the cylinder space to support the on/off valve in an elastic manner.

The on/off valve may include a first compression unit compressed by a suction pressure of the suction unit, a second compression unit compressed by a discharge pressure of the discharge unit and formed on an opposite side to the first compression unit in a moving direction of the on/off valve, and an opening unit configured to open/close the compression unit flow path.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
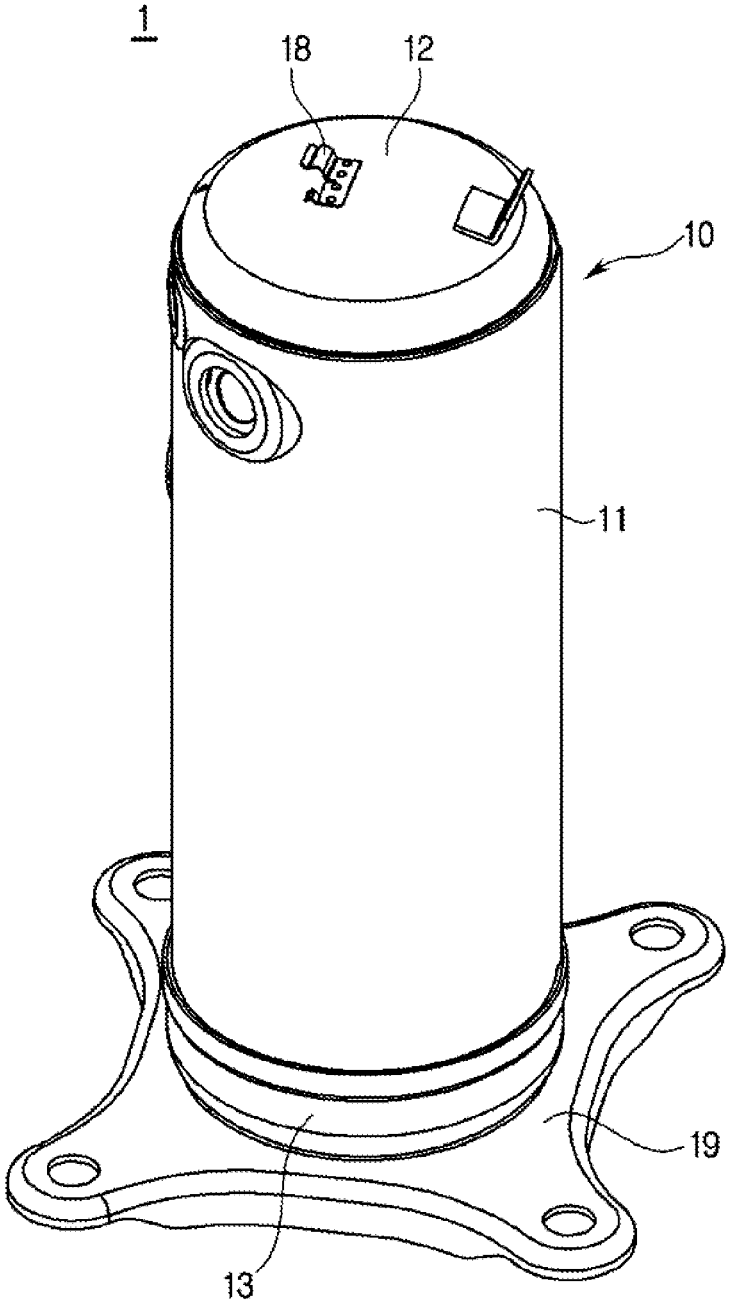
FIG. 1 is a view illustrating an exterior of a compressor in accordance with an embodiment of the disclosure.

Reference will now be made in detail to embodiments of the disclosure, examples of which are illustrated in the accompanying drawings, wherein like reference numerals refer to like elements throughout.

Figure 2:
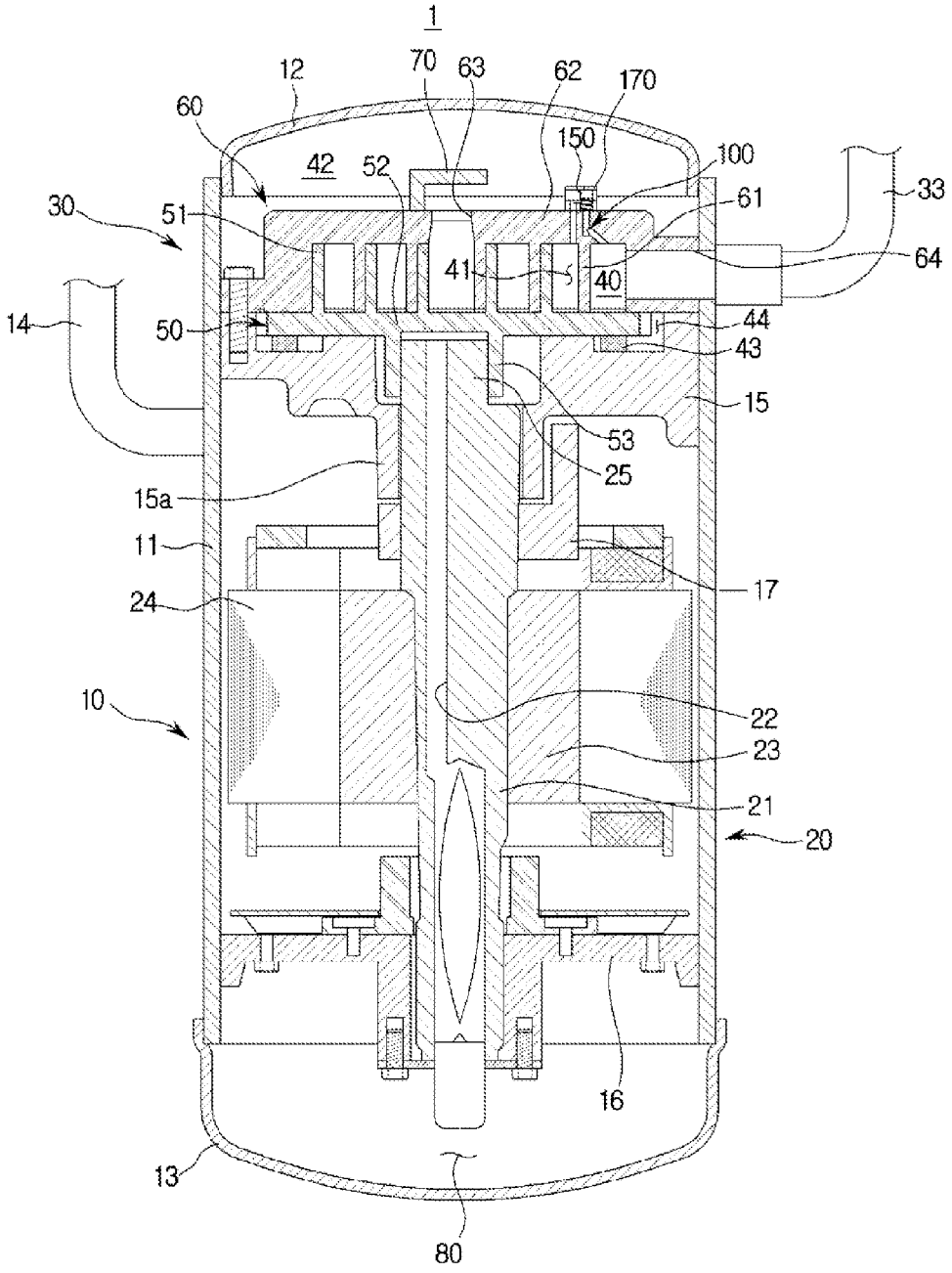
FIG. 2 is a cross-sectional view schematically illustrating a configuration of the compressor of FIG. 1.
Figure 15:
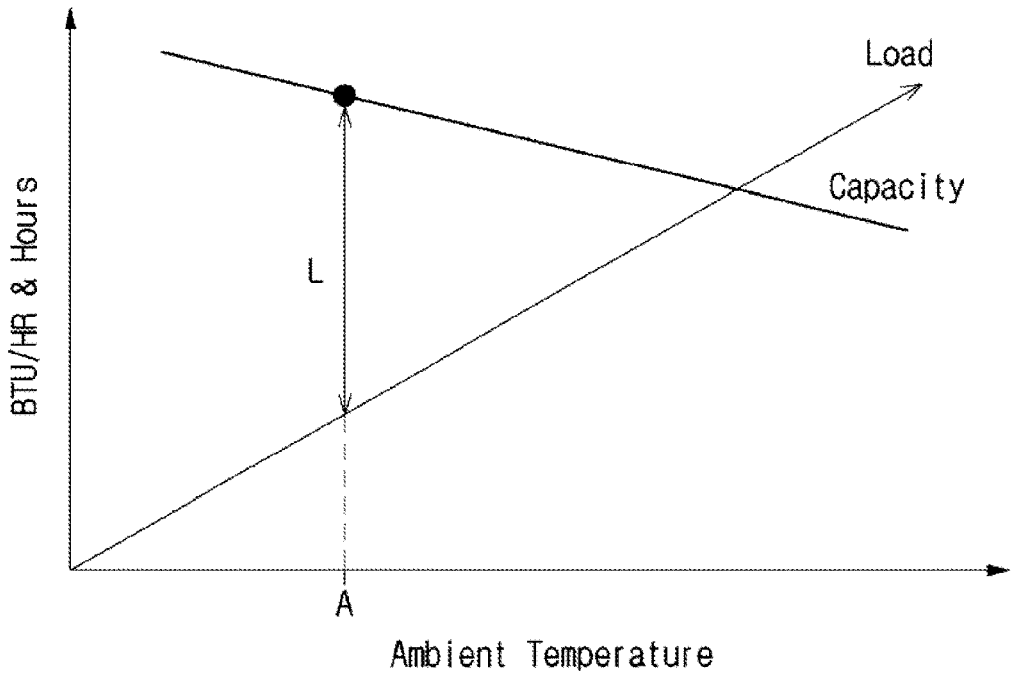
FIG. 15 is a graph illustrating the comparison between a cooling load and a cooling capacity of a constant speed compressor according to an ambient temperature.
Figure 16:
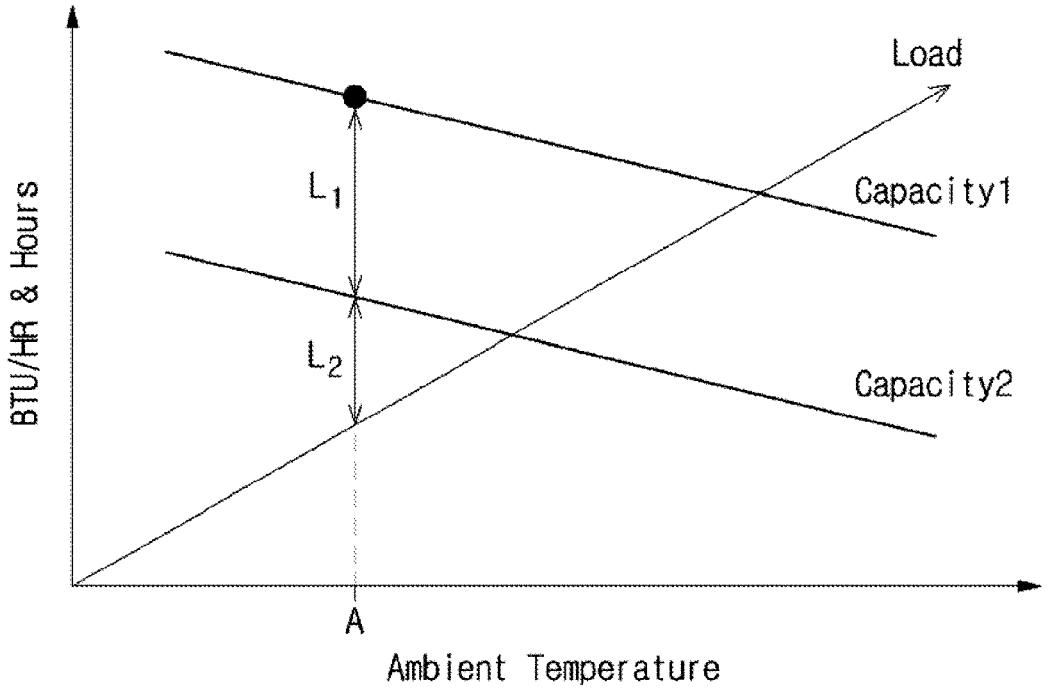
FIG. 16 is a graph illustrating the comparison between a cooling load and a cooling capacity of a two-stage variable capacity compressor according to an ambient temperature.

FIG. 1 is a view illustrating an exterior of a compressor in accordance with an embodiment of the disclosure. FIG. 2 is a cross-sectional view schematically illustrating a configuration of the compressor of FIG. 1. FIG. 15 is a graph illustrating the comparison between a cooling load and a cooling capacity of a constant speed compressor according to an ambient temperature. FIG. 16 is a graph illustrating the comparison between a cooling load and a cooling capacity of a two-stage variable capacity compressor according to an ambient temperature.

Referring to FIGS. 1 and 2, a compressor 1 may include a case 10 having a closed inner space, a compression mechanism unit 30 compressing refrigerant, and a driving mechanism unit 20 providing a driving force to the compression mechanism unit 30.

The case 10 may be formed by combining with a main case 11 formed in a shape of cylinder having an upper end thereof and a lower end thereof open, an upper case 12 closing an opened upper end, and a lower case 13 closing an opened lower end. A bottom plate 19 to be stably supported by the bottom and a fixation member 18 to be fixed with an outdoor unit may be provided in the case 10.

A suction pipe 33 to which refrigerant is introduced may be connected to one side of the case 10, and a discharge pipe 14 to which compressed refrigerant is discharged may be connected to the other side of the case 10.

The driving mechanism unit 20 may be provided in a lower portion of the case 10. The driving mechanism unit 20 may include a stator 24 provided on an outside, a rotor 23 rotated inside of the stator 24 and a rotation shaft 21 mounted to the inside of the rotor 23 to be rotated with the rotor 23 to transmit a torque of the driving mechanism unit 20 to the compression mechanism unit 30.

On an upper end of the rotation shaft 21, an eccentric unit 25 formed to be biased toward one side with respect to a rotation center of the rotation shaft 21 may be provided. The eccentric unit 25 may be coupled to a shaft coupling unit 53 of the orbiting scroll 50 so that a torque may be transmitted to the orbiting scroll 50. Inside the rotation shaft 21, an oil supply flow path 22 may be formed in a shaft direction of the rotation shaft 21. On a lower end portion of the supply oil flow path 22, an oil pump (not shown) may be provided.

On an upper portion or a lower portion of the rotor 23, a balance weight 17 may be installed to adjust an unbalanced state of rotation when the rotor 23 is rotated.

On an inner upper portion and an inner lower portion of the case 10, an upper frame 15 and a lower frame 16 may be provided to fix various structures of the inside of the case 10.

In the center of the upper frame 15, a shaft supporting unit 15*a* may be provided to rotatably support the rotation shaft 21.

The compression mechanism unit 30 may include a fixed scroll 60 fixed to the inside of the case 10 and the orbiting scroll 50 disposed on a lower side of the fixed scroll 60 and configured to be rotated. The fixed scroll 60 and the orbiting scroll 50 may be provided on an upper side of the upper frame 15.

The fixed scroll 60 may include a plate unit 62 formed in a shape of a substantially or approximately flat circular plate, and a fixed wrap unit 61 protruded from a lower surface of the plate unit 62. The fixed wrap unit 61 may have a spiral shape. Particularly, the fixed wrap unit 61 may have an involute shape or an algebraic spiral shape.

The fixed scroll 60 may be fixedly coupled to the upper frame 15. The fixed scroll 60 may be screw-coupled to the upper frame 15. For this, a screw coupling hole 65*a* (refer to FIG. 3) may be formed in the fixed scroll 60. The screw coupling hole 65*a* may be formed on a flange unit 65 (refer to FIG. 3) protruded toward the outside from the plate unit 62.

The orbiting scroll 50 may include a plate unit 52 formed in a shape of a substantially or approximately flat circular plate, and an orbiting wrap unit 51 protruded from an upper surface of the plate unit 52. On the center of the lower surface of the plate unit 52, a shaft coupling unit 53 may be provided to be coupled to the rotation shaft 21. The orbiting wrap unit 51 may have a spiral shape. Particularly, the orbiting wrap unit 51 may have an involute shape or an algebraic spiral shape.

The fixed wrap unit 61 of the fixed scroll 60 and the orbiting wrap unit 51 of the orbiting scroll 50 may be engaged with each other so that a compression unit 41 compressing refrigerant and a suction unit 40 performing suction of refrigerant to be delivered to the compression unit 41 may be formed. The compression unit 41 may compress refrigerant in a way that the capacity of the compression unit 41 may be reduced while moving toward the center of the fixed scroll 60 and the orbiting scroll 60 according to the revolution of the orbiting scroll 50. Refrigerant compressed by the compression unit may be discharged to the discharge unit 42.

Figure 3:
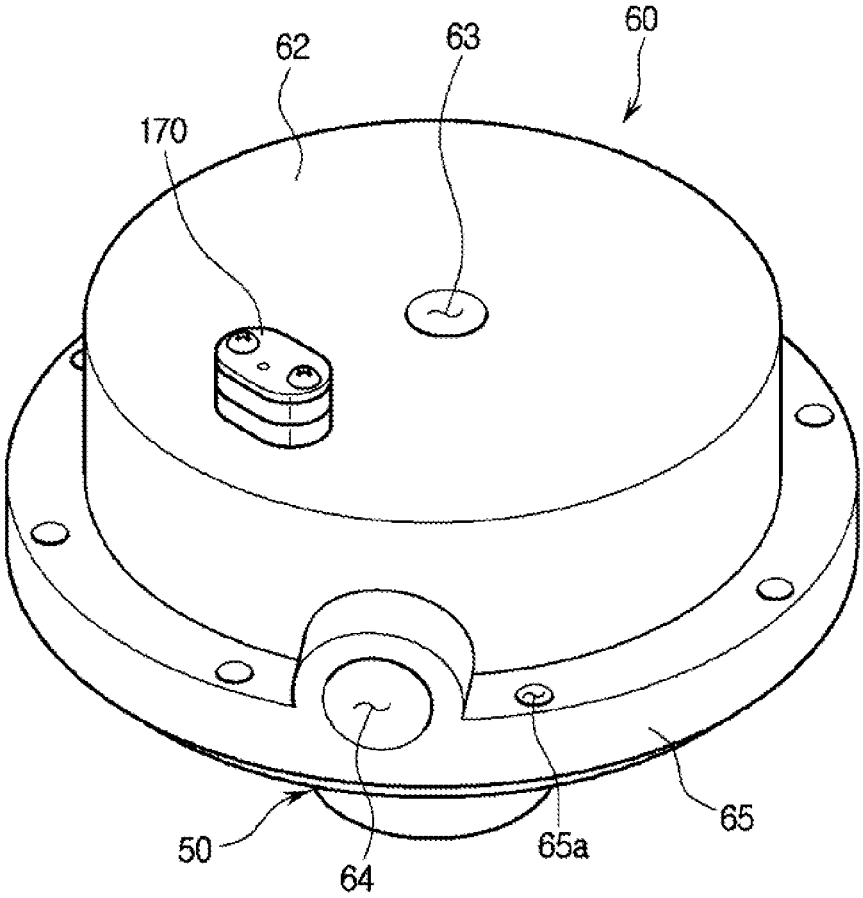
FIG. 3 is a view illustrating a main portion of a bypass structure of the compressor of FIG. 1.

In the center of the fixed scroll 60, a discharge hole 63 configured to discharge refrigerant compressed by the compression unit 41 to the discharge unit 42 in an upper side of the case 10 may be formed. In the discharge hole 63, a backflow prevention member 70 may be provided to prevent the backflow of the refrigerant. A suction inlet (hole) 64 may be provided on a side of the fixed scroll 60 to receive refrigerant which is introduced via suction pipe 33. As shown in FIG. 3, the suction inlet (hole) 64 may be disposed on an outer circumferential side of the plate unit 62 and formed (e.g., integrally) on an upper portion of the flange unit 65.

An Oldham's ring accommodation unit 44 may be provided between the orbiting scroll 50 and the upper frame 15. An Oldham's ring 43 may be configured to allow the orbiting scroll 50 to revolve (rotate or move) about the fixed scroll and to prevent self-rotation. The Oldhams's ring 43 may be accommodated in the Oldham's ring accommodation unit 44.

On a lower portion of the case 10, an oil storage 80 may be provided. A lower end of the rotation shaft 21 may be extended to the oil storage 80 so that oil stored in the oil storage 80 may be raised via the oil supply flow path 22 of the rotation shaft 21.

Oil stored in the oil storage 80 may be pumped by an oil pump (not shown) installed on a lower end of the rotation shaft 21, and then may be raised to an upper end of the rotation shaft 21 along the oil supply flow path 22 formed inside the rotation shaft 21. Oil reaching the upper end of the rotation shaft 21 may be supplied between each component according to the rotation of the orbiting scroll 50 and may perform a lubrication action.

A variable capacity structure may be provided in the fixed scroll 60. In the fixed scroll 60, a bypass flow path 100 may be formed to communicate the suction unit 40 and the compression unit 41. In the bypass flow path 100, an on-off valve 150 may be provided to open/close the bypass flow path 100 according to a difference pressure between a discharge pressure of the discharge unit 42 and a suction pressure of the suction unit 40. A valve housing 170 may be coupled to an upper surface of the plate unit 62 of the fixed scroll 60.

The variable capacity structure may be configured to reduce the capacity of the compressor so that the compressor may be driven without requiring that the on/off driving of a conventional compressor when a load is lower than the maximum cooling load.

As illustrated in FIG. 15, in general, a cooling load may vary according to an ambient temperature. That is, the cooling load may be increased as an ambient temperature is higher, and the cooling load may be decreased as an ambient temperature is lower.

In general, the cooling capacity of the compressor may be configured in accordance with the maximum cooling capacity. Therefore, when a load is lower than the maximum cooling capacity (e.g., when an ambient temperature is A) a cooling capacity may be larger than a load and thus loss L may occur. Accordingly, the compressor may perform on/off driving, and thus the consumption of electricity may be increased and the efficiency may be reduced.

As illustrated in FIG. 16, a loss L1 may be compensated by reducing the rotation speed by using an inverter motor. That is, the cooling capacity of the compressor in a low speed mode (capacity 2) may be lower than the cooling capacity of the compressor in a high speed mode (capacity 1).

However, when the rotation speed is excessively low, a leakage and a difficulty in supplying oil may occur, and thus there may be the limitation in reducing the rotation speed. Therefore a loss L2 may still occur.

A capacity reduction structure of the compressor according to embodiments of the disclosure may reduce a capacity of compressed refrigerant so that the loss L2 may be compensated (reduced) more. The capacity reduction structure of the compressor according to embodiments of the disclosure may communicate the suction unit 40 with the compression unit 41 to allow the compression of the refrigerant to be practically started late with a certain phase difference so that the capacity of the compressed refrigerant may be reduced.

The capacity reduction structure of the compressor according to embodiments disclosed herein may be configured in a way that when a difference Pd−Ps between a discharge pressure Pd of the discharge unit 42 and a suction pressure Ps of the suction unit 40 is less than a predetermined pressure Pr, a capacity of the compressor may be reduced, and when the difference Pd−Ps between the discharge pressure Pd of the discharge unit 42 and the suction pressure Ps of the suction unit 40 is larger than the predetermined pressure Pr, the capacity of the compressor may be not reduced. That is, the capacity reduction structure of the compressor according to embodiments may be driven based on the difference Pd−Ps between the discharge pressure Pd of the discharge unit 42 and the suction pressure Ps of the suction unit 40. Alternatively, the capacity reduction structure may be driven based on a compression rate Pd/Ps between the discharge pressure Pd of the discharge unit 42 and the suction pressure Ps of the suction unit 40.

As mentioned above, the reason why the capacity reduction structure of the compressor is driven based on the difference Pd−Ps between the discharge pressure Pd of the discharge unit 42 and the suction pressure Ps of the suction unit 40 may be that the difference Pd−Ps between the discharge pressure Pd of the discharge unit 42 and the suction pressure Ps of the suction unit 40 may vary according to load conditions.

For example, as the cooling capacity is larger, the difference Pd−Ps between the discharge pressure Pd and the suction pressure Ps, and the compression rate Pd/Ps between the discharge pressure Pd and the suction pressure Ps may be increased, and as the cooling capacity is less, the difference Pd−Ps between the discharge pressure Pd and the suction pressure Ps, and the compression rate Pd/Ps between the discharge pressure Pd and the suction pressure Ps may be decreased.

Therefore, the capacity reduction structure according to embodiments may reduce the compression capacity under a low load condition, and conversely the capacity reduction structure may compress to a predetermined maximum compression capacity under a high load condition. When the capacity reduction structure according to embodiments applies to an inverter compressor, a capacity of the compressor may be reduced more in a low speed mode and thus the optimized efficiency may be performed. In addition, the capacity reduction structure according to embodiments may apply a constant speed compressor as well as an inverter compressor. The description of the capacity reduction structure will be described in the following.

Figure 4:
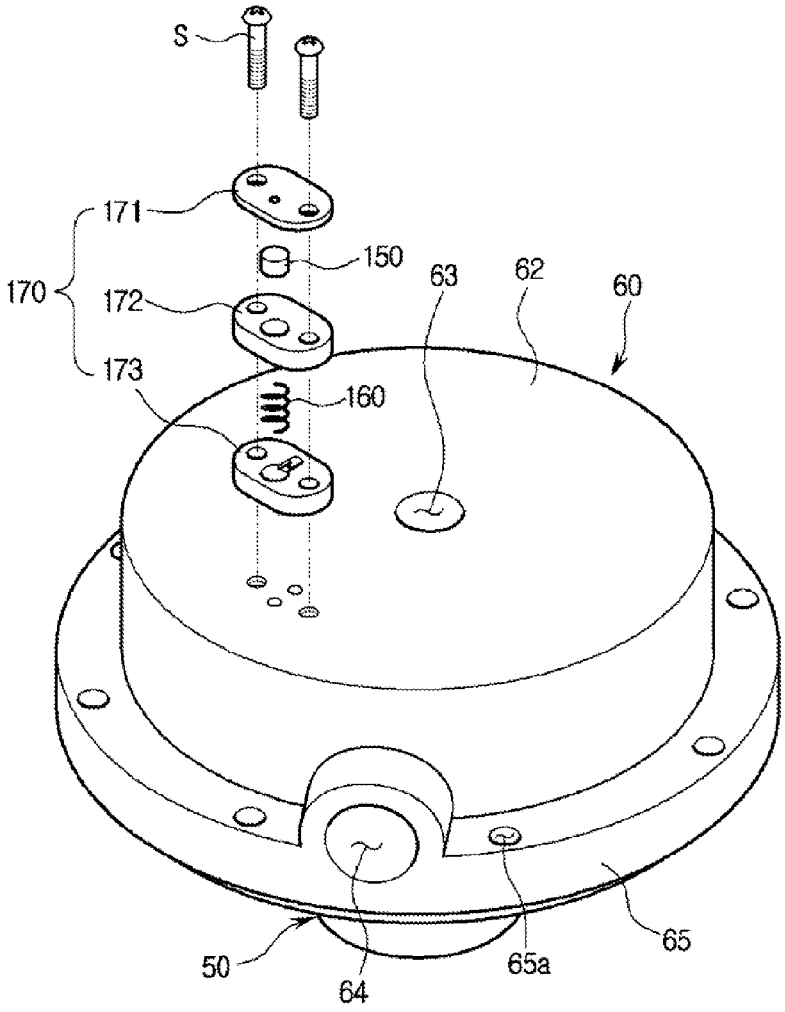
FIG. 4 is an exploded-perspective view illustrating a main portion of a bypass structure of the compressor of FIG. 1.
Figure 5:
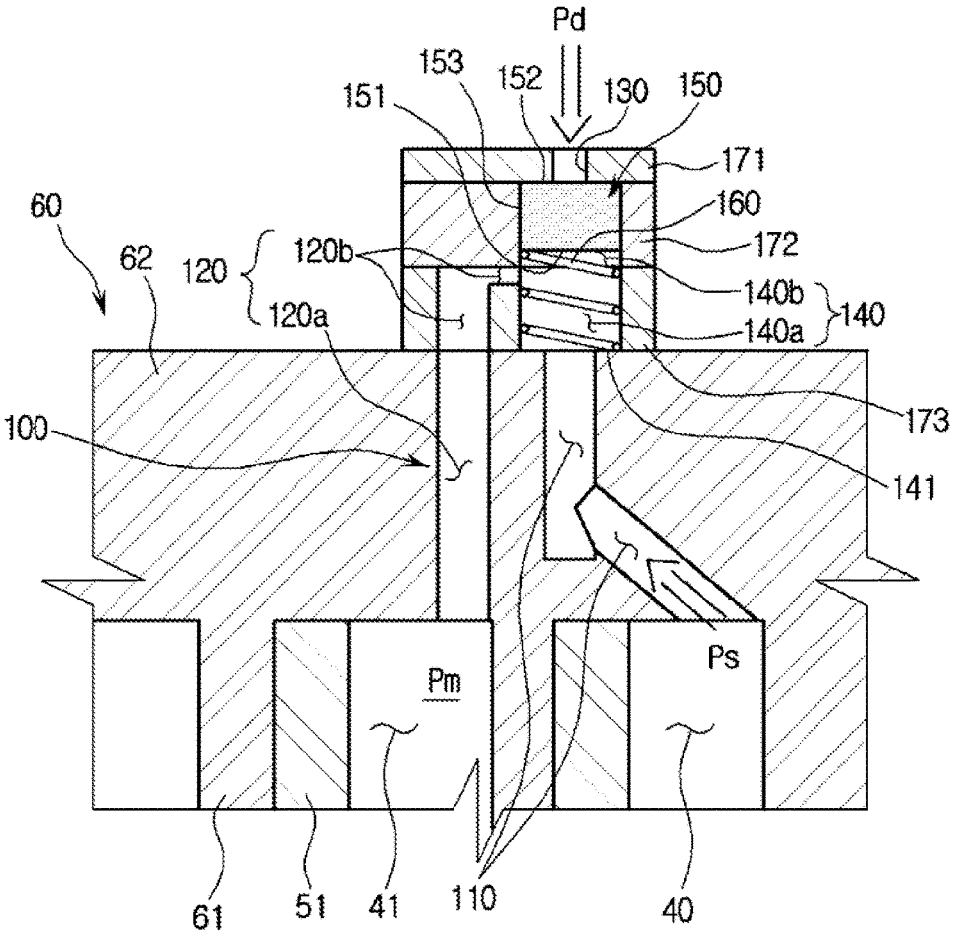
FIG. 5 is a cross-sectional view illustrating a state in which a bypass flow path of the compressor of FIG. 1 is open.
Figure 6:
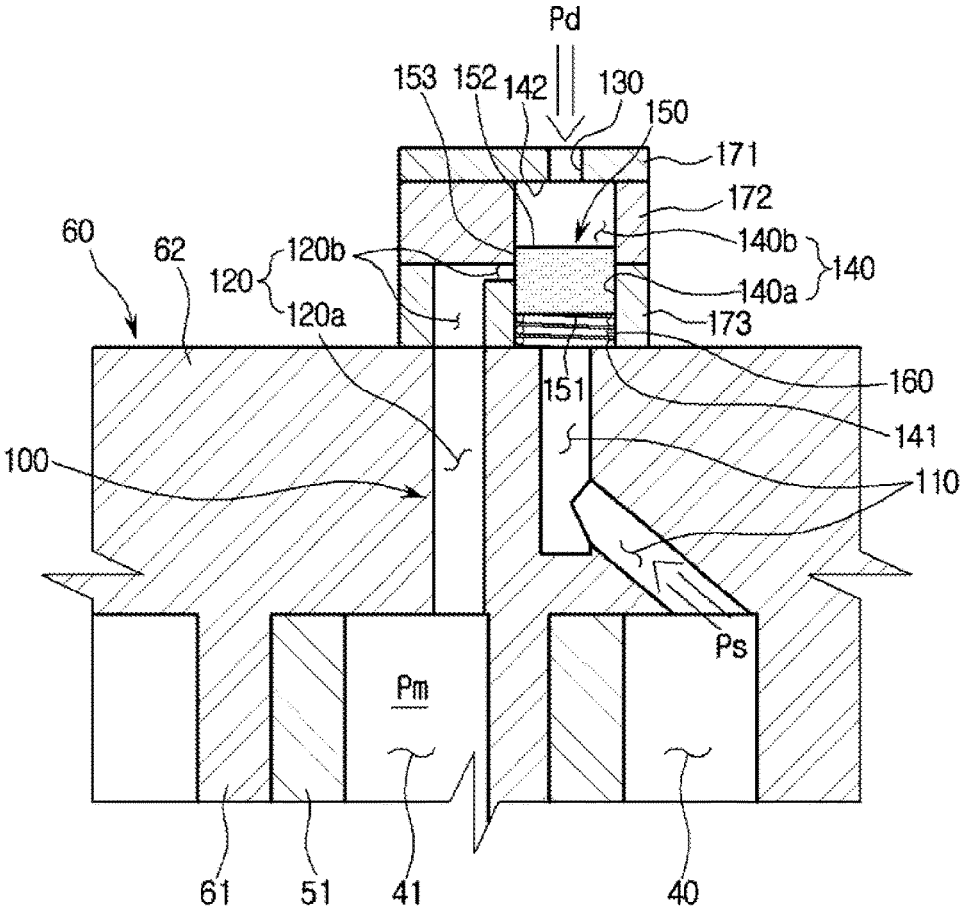
FIG. 6 is a cross-sectional view illustrating a state in which a bypass flow path of the compressor of FIG. 1 is closed.
Figure 10:
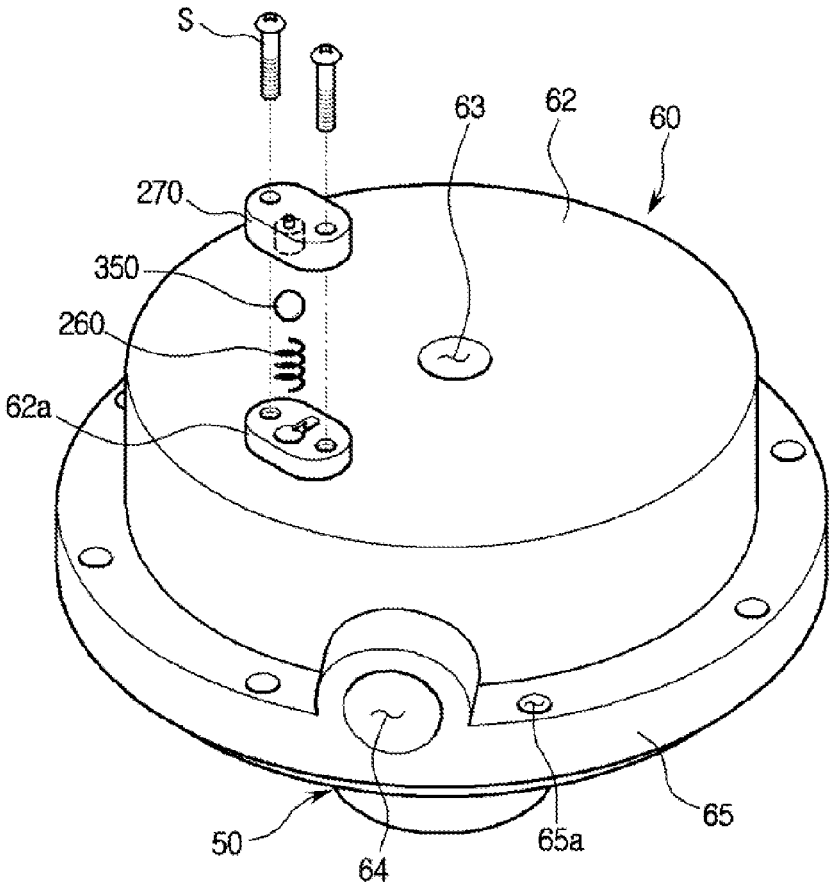
FIG. 10 is an exploded-perspective view illustrating a main portion of a bypass structure of a compressor in accordance with an embodiment of the disclosure.
Figure 11:
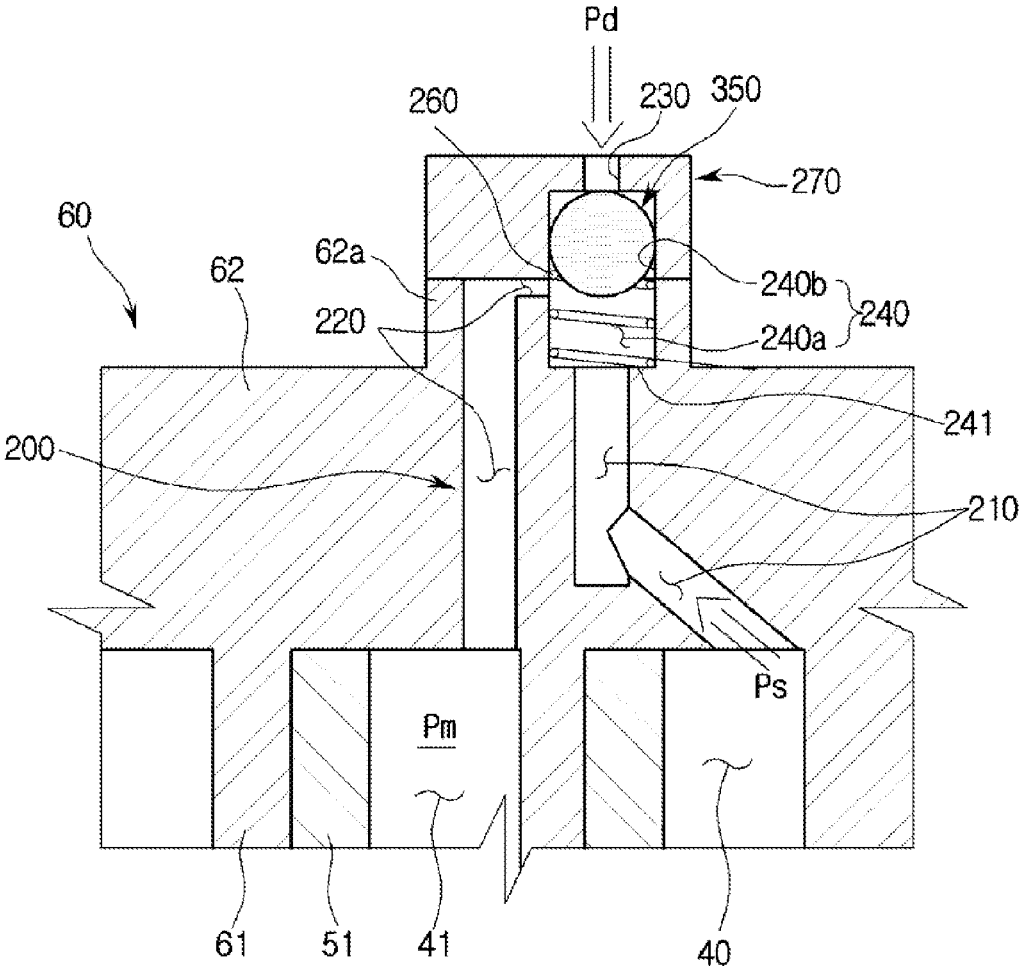
FIG. 11 is a cross-sectional view illustrating a state in which a bypass flow path of the compressor of FIG. 10 is open.
Figure 12:
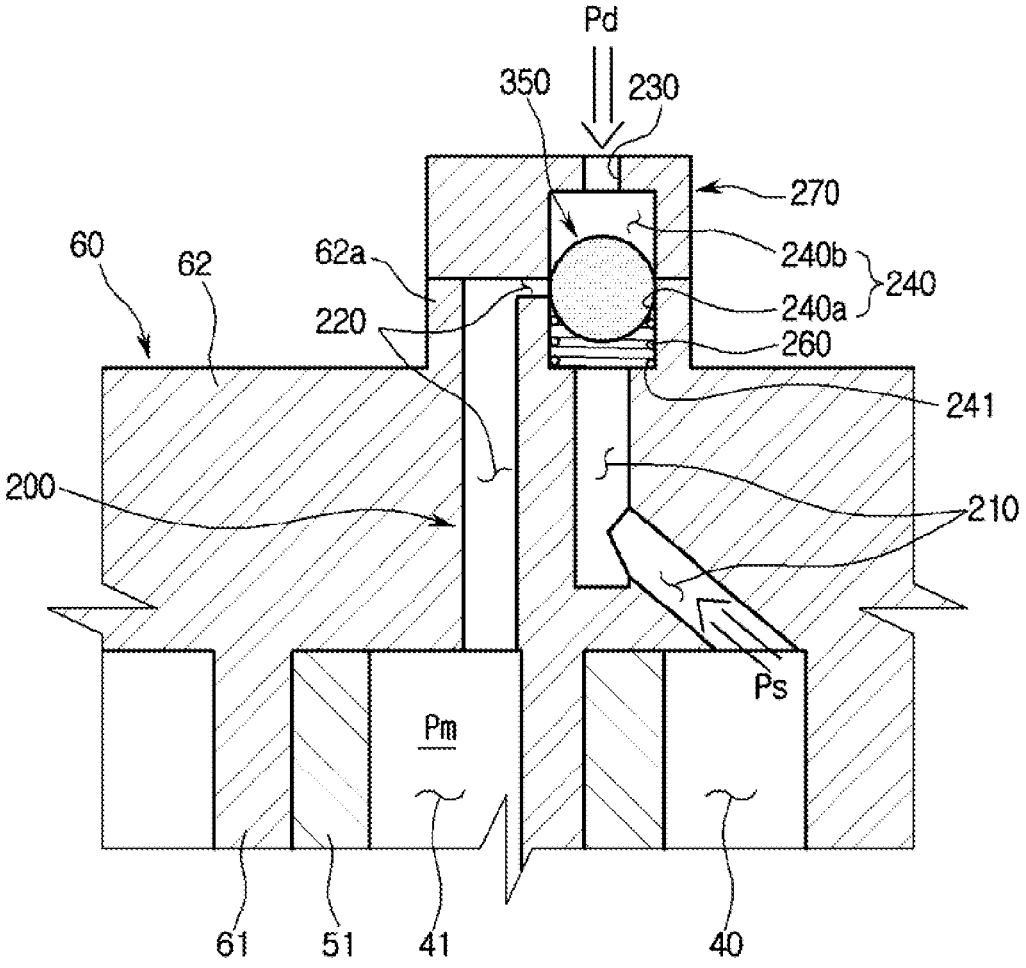
FIG. 12 is a cross-sectional view illustrating a state in which a bypass flow path of the compressor of FIG. 10 is close.

FIG. 3 is a view illustrating a main portion of a bypass structure of the compressor of FIG. 1. FIG. 4 is an exploded-perspective view illustrating a main portion of a bypass structure of the compressor of FIG. 1. FIG. 5 is a cross-sectional view illustrating a state in which a bypass flow path of the compressor of FIG. 1 is open. FIG. 6 is a cross-sectional view illustrating a state in which a bypass flow path of the compressor of FIG. 1 is close. FIG. 10 is an exploded-perspective view illustrating a main portion of a bypass structure of a compressor in accordance with an embodiment of the disclosure. FIG. 11 is a cross-sectional view illustrating a state in which a bypass flow path of the compressor of FIG. 10 is open. FIG. 12 is a cross-sectional view illustrating a state in which a bypass flow path of the compressor of FIG. 10 is close. An arrow displayed in FIGS. 5 and 6 may represent an action direction of the suction pressure Ps and the discharge pressure Pd applied to the on/off valve.

Referring to FIGS. 3 to 6, a capacity reduction structure according to an embodiment of the disclosure will be described.

A valve housing 170 may be coupled to an upper surface of a fixed scroll 60. The valve housing 170 may include a bottom housing 173 coupled to an upper surface of the fixed scroll 60, an intermediate housing 172 coupled to the bottom housing 173, and a cover housing 171 coupled to the intermediate housing 172. The valve housing 170 may be coupled to the fixed scroll 60 by a screw member S, but is not limited thereto. The valve housing 170 may be integrally formed or may be formed by one or two components.

The fixed scroll 60 may be provided with a bypass flow path 100 configured to connect a suction unit 40 to a compression unit 41, a cylinder space 140 provided on the bypass flow path 100, and an on-off valve 150 movable back and forth in the cylinder space 140 to open/close the bypass flow path 100 according to a difference Pd−Ps between a discharge pressure Pd of a discharge unit 42 and a suction pressure Ps of a suction unit 40.

The bypass flow path 100 may include a suction unit flow path 110 connecting the cylinder space 140 to the suction unit 40, a compression unit flow path 120 connecting the cylinder space 140 to the compression unit 41. Herein, Pm may represent a pressure of the compression unit 41. Refrigerant may be suctioned in the suction unit 40, compressed in the compression unit 41, and discharged to the discharge unit 42. Accordingly a relation of $Ps<Pm<Pd$ may be formed. In the fixed scroll 60, a discharge unit flow path 130 connecting the cylinder space 140 to the discharge unit 42 may be formed.

The on/off valve 150 disposed in the cylinder space 140 may be disposed to be movable back and forth in a vertical direction. That is, the cylinder space 140 may be formed to be long (extend longitudinally) in the vertical direction. Alternatively, the on/off valve 150 may be provided to be movable back and forth in a horizontal direction or in a diagonal direction.

The on/off valve 150 may be formed in a shape of a cylinder, substantially or approximately. The on/off valve 150 may include a first compression unit 151 compressed by the suction pressure Ps of the suction unit 40 and a second compression unit 152 compressed by the discharge pressure Pd of the discharge unit 42. The first compression unit 151 and the second compression unit 152 may be disposed to be opposite of one another (i.e., on opposite sides of the on/off valve 150).

The on/off valve 150 may include an opening unit 153 opening/closing the bypass flow path 100. The opening unit 153 may be provided on a lateral side of the on/off valve 150.

In the cylinder space 140, an elastic member 160 may be provided to support the on/off valve 150 in an elastic manner. The elastic member 160 may be a coil spring. One end of the elastic member 160 may be supported by an elastic member supporting unit 141 and the other end of the elastic member 160 may be supported by the on/off valve 150.

Particularly, the other end of the elastic member 160 may be supported by the first compression unit 151 of the on/off valve 150. That is, the elastic member 160 may be disposed on the suction unit flow path 110 side and not the discharge unit flow path 130 side with respect to the on/off valve 150.

The elastic member 160 may be disposed to allow the on/off valve 150 to be elastically biased toward the discharge unit flow path 130. That is, the elastic member 160 may bias the on/off valve 150 toward the discharge unit flow path 130 in an elastic manner so that the on/off valve 150 may connect the suction unit flow path 110 to the compression unit flow path 120.

In the discharge unit flow path 130 side of the cylinder space 140, a stopper unit 142 configured to regulate a moving distance of the on/off valve 150 may be provided.

By using the aforementioned configuration, the on/off valve 150 may be moved back and forth by a resultant force of a force applied to the on/off valve 150 by the difference Pd−Ps between the discharge pressure Pd and the suction pressure Ps, and a force applied to the on/off valve 150 by an elastic force of the elastic member 160.

Therefore, the elastic coefficient of the elastic member 160 may become a factor determining the difference Pd−Ps between the discharge pressure Pd and the suction pressure Ps, which is a predetermined pressure Pr, opening or closing the bypass flow path 100. That is, by adjusting the elastic coefficient of the elastic member 160, the difference Pd−Ps between the discharge pressure Pd and the suction pressure Ps, which is a predetermined pressure Pr, opening or closing the bypass flow path 100 may be determined.

According to another aspect of the disclosure, the predetermined pressure Pr may be determined by making a cross section area of the first compression unit 151 and a cross section area of the second compression unit 152 to be different from each other, instead of using the elastic member 160.

As illustrated in FIG. 5, when the difference Pd−Ps between the discharge pressure Pd and the suction pressure Ps is less than the predetermined pressure Pr, that is under a low load condition, the on/off valve 150 may be moved toward the discharge unit flow path 130 and connect the suction unit flow path 110 to the compression unit flow path 120. Accordingly, the bypass flow path 100 may be opened.

As illustrated in FIG. 6, when the difference Pd−Ps between the discharge pressure Pd and the suction pressure Ps is larger than the predetermined pressure Pr, that is under a high load condition, the on/off valve 150 may be moved toward the suction unit flow path 110 and release the connection of the suction unit flow path 110 and the compression unit flow path 120. Accordingly, the bypass flow path 100 may be closed.

The cylinder space 140 may include a lower cylinder space 140*a* formed in a bottom housing 173 of the valve housing 170 and an upper cylinder space 140*b* formed in an intermediate housing 172 of the valve housing 170.

The compression unit flow path 120 may be formed by connecting a first compression unit flow path 120*a* formed in the plate unit 62 of the fixed scroll 60 to a second compression unit flow path 120*b* formed in the bottom housing 173 of the valve housing 170.

The discharge unit flow path 130 may be formed in the cover housing 171 of the valve housing 170.

Figure 7:
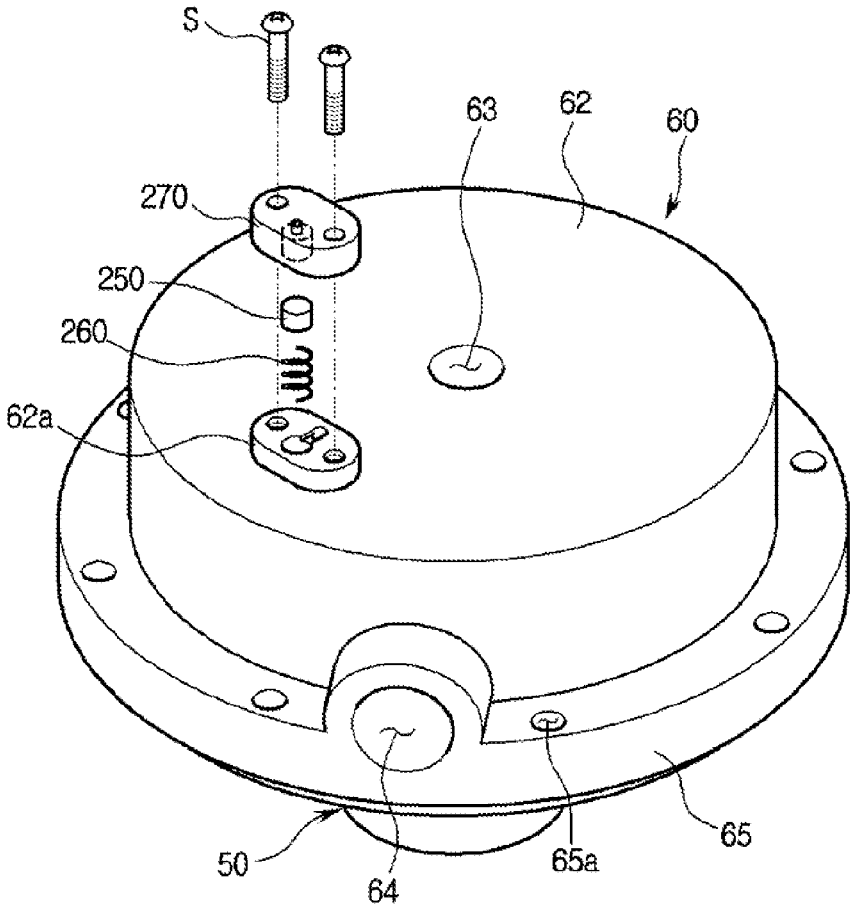
FIG. 7 is an exploded-perspective view illustrating a main portion of a bypass structure of a compressor in accordance with an embodiment of the disclosure.
Figure 8:
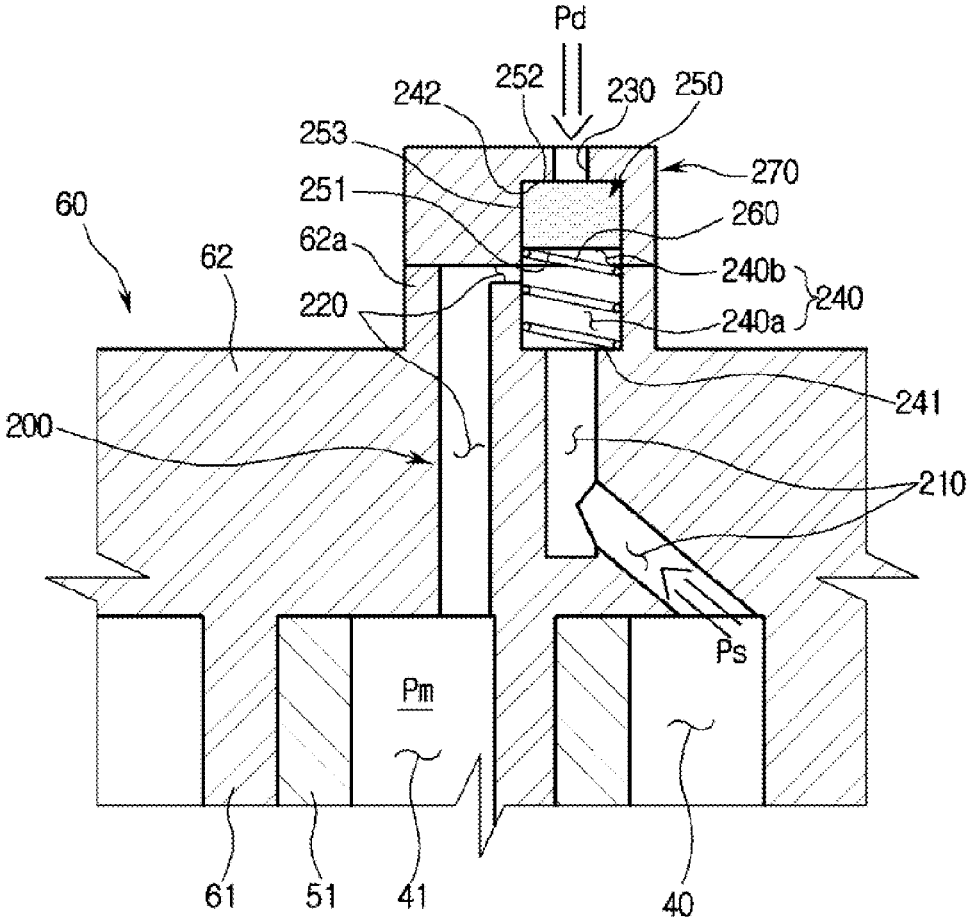
FIG. 8 is a cross-sectional view illustrating a state in which a bypass flow path of the compressor of FIG. 7 is open.
Figure 9:
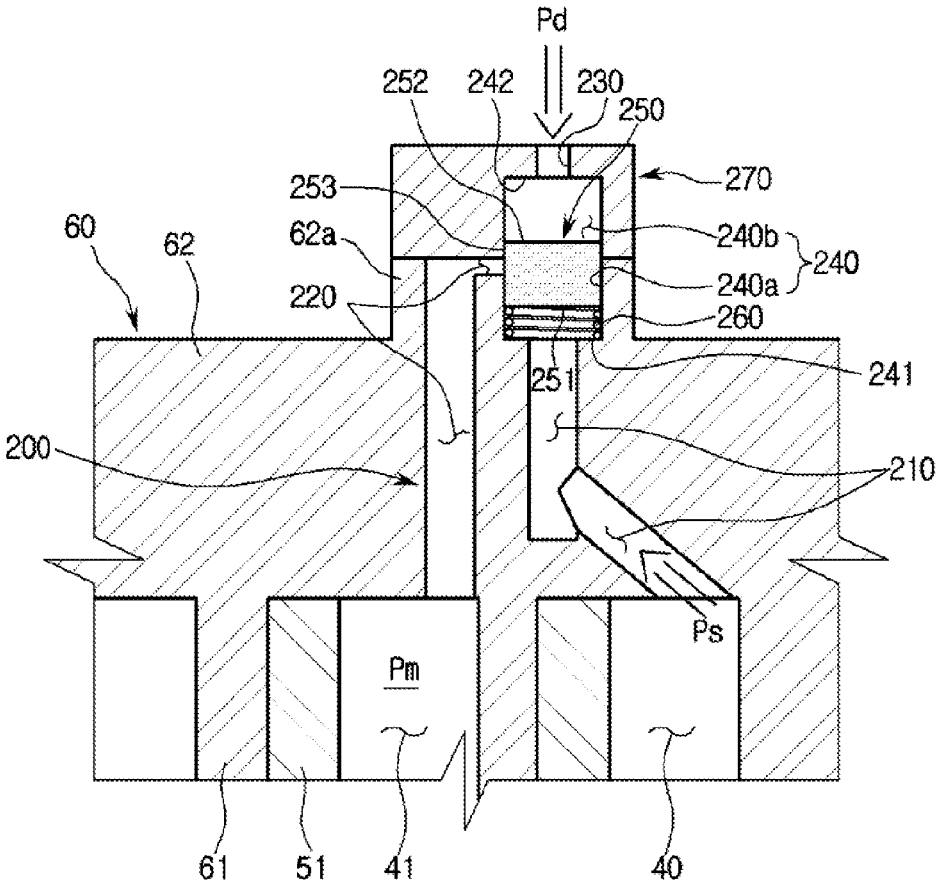
FIG. 9 is a cross-sectional view illustrating a state in which a bypass flow path of the compressor of FIG. 7 is close.

FIG. 7 is an exploded-perspective view illustrating a main portion of a bypass structure of a compressor in accordance with an embodiment of the disclosure. FIG. 8 is a cross-sectional view illustrating a state in which a bypass flow path of the compressor of FIG. 7 is open. FIG. 9 is a cross-sectional view illustrating a state in which a bypass flow path of the compressor of FIG. 7 is closed. FIG. 10 is an exploded-perspective view illustrating a main portion of a bypass structure of a compressor in accordance with an embodiment of the disclosure. FIG. 11 is a cross-sectional view illustrating a state in which a bypass flow path of the compressor of FIG. 10 is open. FIG. 12 is a cross-sectional view illustrating a state in which a bypass flow path of the compressor of FIG. 10 is closed. An arrow displayed in FIGS. 8, 9, 11, and 12 may represent an action direction of the suction pressure Ps and the discharge pressure Pd applied to the on/off valve.

Referring to FIGS. 7 to 9, a bypass structure of a compressor in accordance with an embodiment of the disclosure will be described. The same parts as those discussed previously will have the same reference numerals and a description thereof will be omitted.

A valve housing 270 may be coupled to an upper surface of a fixed scroll 60. A plate unit 62 of the fixed scroll 60 may include a protrusion unit 62*a* protruded toward an upper side. The valve housing 270 may be coupled to the protrusion unit 62*a*. The valve housing 270 may be coupled to the protrusion unit 62*a* by a screw member S.

The fixed scroll 60 may be provided with a bypass flow path 200 connecting a suction unit 40 and a compression unit 41, a cylinder space 240 provided on the bypass flow path 200, and an on-off valve 250 movable back and forth in the cylinder space 240 to open/close the bypass flow path 200 according to a difference Pd−Ps between a discharge pressure Pd of a discharge unit 42 and a suction pressure Ps of a suction unit 40.

The bypass flow path 200 may include a suction unit flow path 210 connecting the cylinder space 240 to the suction unit 40, a compression unit flow path 220 connecting the cylinder space 240 to the compression unit 41. In the fixed scroll 60, a discharge unit flow path 230 connecting the cylinder space 240 to the discharge unit 42 may be formed.

The on/off valve 250 disposed in the cylinder space 240 may be disposed to be movable back and forth in a vertical direction. That is, the cylinder space 240 may be formed to be long (extend longitudinally) in the vertical direction. Alternatively, the on/off valve 250 may be provided to be movable back and forth in a horizontal direction or in a diagonal direction.

The on/off valve 250 may be formed in a shape of a cylinder, substantially or approximately. The on/off valve 250 may include a first compression unit 251 compressed by the suction pressure Ps of the suction unit 40 and a second compression unit 252 compressed by the discharge pressure Pd of the discharge unit 42. The first compression unit 251 and the second compression unit 252 may be disposed to be opposite of one another (i.e., on opposite sides of the on/off valve 250).

The on/off valve 250 may include an opening unit 253 opening/closing the bypass flow path 200. The opening unit 253 may be provided on a lateral side of the on/off valve 250.

However, the shape of the on/off valve 350 is not limited to a cylinder, and as illustrated in FIGS. 10 to 12, the on/off valve 350 may be formed in a shape of a sphere. The on/off valve 350 may have a sphere shape so that the friction between the on/off valve 350 and the cylinder space 240 may be reduced and thus the movement stability of the on/off valve 350 may be improved.

In the cylinder space 240, an elastic member 260 may be provided to elastically support the on/off valve 250. The elastic member 260 may be a coil spring. One end of the elastic member 260 may be supported by an elastic member supporting unit 241 and the other end of the elastic member 260 may be supported by the on/off valve 250.

Particularly, the other end of the elastic member 260 may be supported by the first compression unit 251 of the on/off valve 250. That is, the elastic member 260 may be disposed on the suction unit flow path 210 side and not the discharge unit flow path 230 side with respect to the on/off valve 250.

The elastic member 260 may be disposed to allow the on/off valve 250 to be elastically biased toward the discharge unit flow path 230. That is, the elastic member 260 may elastically bias the on/off valve 250 toward the discharge unit flow path 230 so that the on/off valve 250 may connect the suction unit flow path 210 to the compression unit flow path 220.

In the discharge unit flow path 230 side of the cylinder space 240, a stopper unit 242 configured to regulate a moving distance of the on/off valve 250 may be provided.

The cylinder space 240 may include a lower cylinder space 240*a* formed in the protrusion unit 62*a* of the plate unit 62, and an upper cylinder space 240*b* formed in the valve housing 270. The discharge unit flow path 230 may be formed in the valve housing 270.

The operation of the on/off valve 250 may be the same as that discussed in previous embodiments (e.g., with respect to FIGS. 4 to 6), of the disclosure, and thus a description thereof will be omitted.

By using the aforementioned configuration, the number of the components may be fewer than in the embodiment discussed with respect to FIGS. 4 to 6, and thus assembly may be improved.

Figure 13:
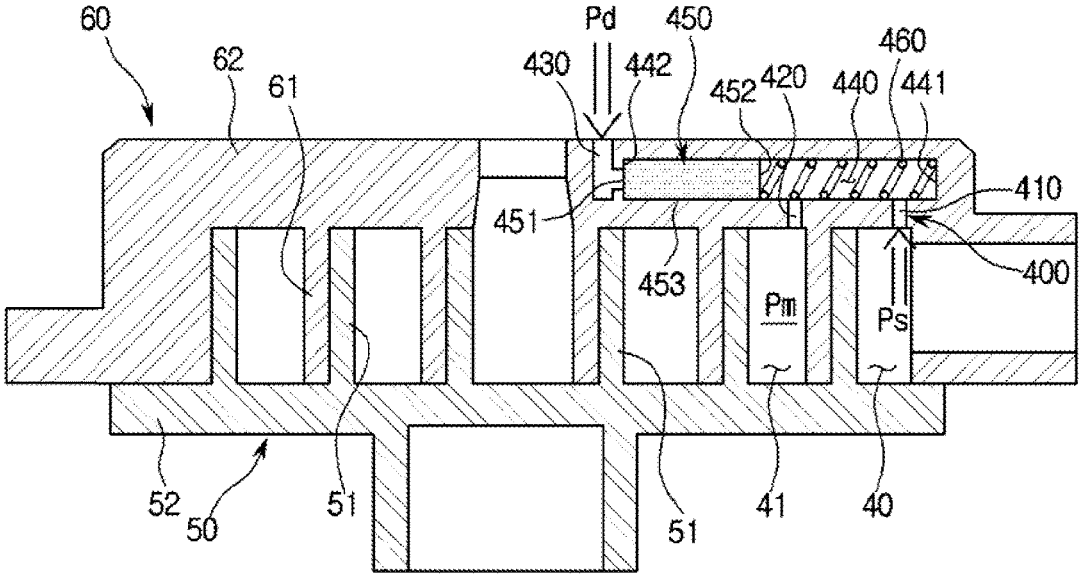
FIG. 13 is a view illustrating a state in which a bypass flow path of a compressor in accordance with an embodiment of the disclosure is open.
Figure 14:
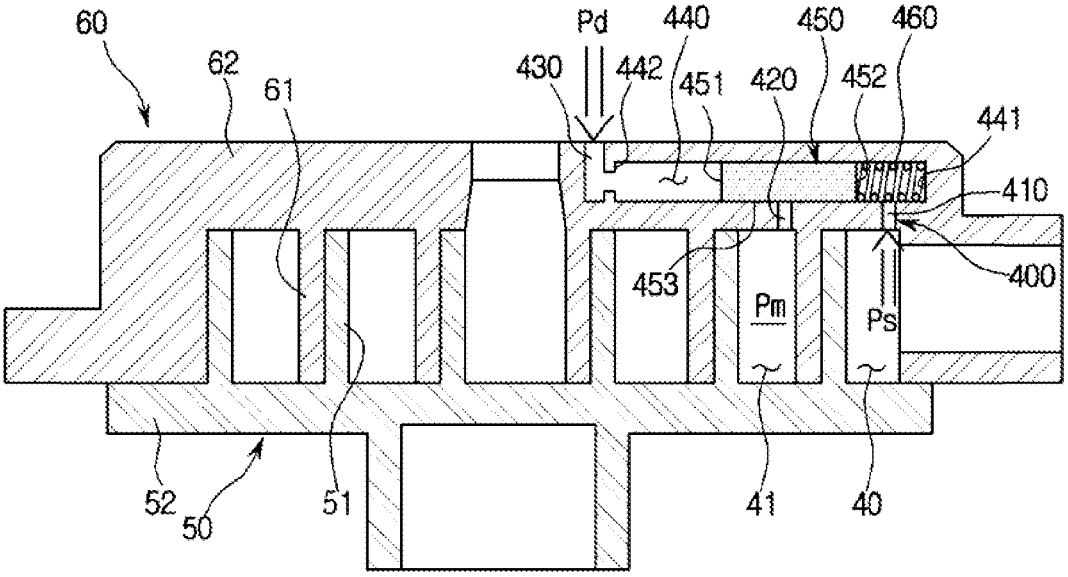
FIG. 14 is a cross-sectional view illustrating a state in which a bypass flow path of the compressor of FIG. 13 is close.

FIG. 13 is a view illustrating a state in which a bypass flow path of a compressor in accordance with an embodiment of the disclosure is open. FIG. 14 is a cross-sectional view illustrating a state in which a bypass flow path of the compressor of FIG. 13 is closed. The same parts as those shown in aforementioned embodiments will have the same reference numerals and a description thereof will be omitted. An arrow displayed in FIGS. 13 and 14 may represent an action direction of the suction pressure Ps and the discharge pressure Pd applied to the on/off valve.

The fixed scroll 60 may be provided with a bypass flow path 400 connecting a suction unit 40 to a compression unit 41, a cylinder space 440 provided on the bypass flow path 400, and an on-off valve 450 movable back and forth in the cylinder space 440 to open/close the bypass flow path 400 according to a difference Pd−Ps between a discharge pressure Pd of a discharge unit 42 and a suction pressure Ps of a suction unit 40.

The bypass flow path 400 may include a suction unit flow path 410 connecting the cylinder space 440 to the suction unit 40, a compression unit flow path 420 connecting the cylinder space 440 to the compression unit 41.

In the fixed scroll 60, a discharge unit flow path 430 connecting the cylinder space 440 to the discharge unit 42 may be formed.

The bypass flow path 400, the cylinder space 440, the suction unit flow path 410, the compression unit flow path 420 and the discharge unit flow path 430 may be formed inside the plate unit 62 of the fixed scroll 60.

Therefore, a capacity reduction structure may not protrude to the outside of the plate unit 62 of the fixed scroll 60 so that the thickness of the fixed scroll 60 may be minimized.

The on/off valve 450 disposed in the cylinder space 440 may be provided to be movable back and forth in a horizontal direction. That is, the cylinder space 440 may be formed to be long (extend longitudinally) in the horizontal direction.

The on/off valve 450 may be formed in a shape of a cylinder, approximately. The on/off valve 450 may include a first compression unit 451 compressed by the suction pressure Ps of the suction unit 40 and a second compression unit 452 compressed by the discharge pressure Pd of the discharge unit 42. The first compression unit 451 and the second compression unit 452 may be disposed to be opposite of one another (i.e., on opposite sides of the on/off valve 450).

The on/off valve 450 may include an opening unit 453 opening/closing the bypass flow path 400. The opening unit 453 may be provided on a lateral side of the on/off valve 450.

In the cylinder space 440, an elastic member 460 may be provided to support elastically the on/off valve 450. One end of the elastic member 460 may be supported by an elastic member supporting unit 441 and the other end of the elastic member 460 may be supported by the on/off valve 450.

Particularly, the other end of the elastic member 460 may be supported by the first compression unit 451 of the on/off valve 450. That is, the elastic member 460 may be disposed on the suction unit flow path 410 side and not the discharge unit flow path 430 side with respect to the on/off valve 450.

The elastic member 460 may be disposed to allow the on/off valve 450 to be elastically biased toward the discharge unit flow path 430. That is, the elastic member 460 may elastically bias the on/off valve 450 toward the discharge unit flow path 430 so that the on/off valve 450 may connect the suction unit flow path 410 to the compression unit flow path 420.

In the discharge unit flow path 430 side of the cylinder space 440, a stopper unit 442 configured to regulate a moving distance of the on/off valve 450 may be provided.

The operation of the on/off valve 450 may be the same as those shown in aforementioned embodiments, and thus a description thereof will be omitted.

As is apparent from the above description, the high efficiency of the air conditioner may be achieved under a low load condition that corresponds to the majority of actual load conditions.

A variable capacity structure having a bypass structure may be provided in the fixed scroll inside the case so that assembly and reliability may be improved.

When the compressor is activated, the on/off valve may be opened, and thus a load applied to the compressor may be reduced.

Although embodiments of the disclosure have been shown and described, it would be appreciated by those skilled in the art that changes may be made to these embodiments without departing from the principles and spirit of the disclosure, the scope of which is defined in the claims and their equivalents.

What is claimed is:

1. A compressor, comprising:

a case;

a fixed scroll fixed to an inside of the case;

an orbiting scroll provided to move about the fixed scroll;

a compression unit formed by the fixed scroll and the orbiting scroll and configured to have a volume that is reduced while the compression unit moves toward a center of the fixed scroll and the orbiting scroll, according to a movement of the orbiting scroll;

a suction unit configured to suction a refrigerant to be delivered to the compression unit;

a discharge unit to which the refrigerant compressed by the compression unit is discharged;

a bypass flow path configured to connect the suction unit to the compression unit, the bypass flow path including a suction unit flow path and a compression unit flow path;

a cylinder space provided on the bypass flow path, the cylinder space being connected to the suction unit via the suction unit flow path and being connected to the compression unit via the compression unit flow path;

a discharge unit flow path configured to directly connect the cylinder space to the discharge unit;

a valve disposed to be movable in the cylinder space to open and close the bypass flow path according to a difference between a discharge pressure of the discharge unit and a suction pressure of the suction unit; and an elastic member disposed in the cylinder space, wherein a leading surface of the valve is configured to move in a first direction perpendicular to the leading surface of the valve toward the suction unit flow path to cut off the suction unit flow path from the compression unit flow path to thereby close the bypass flow path and to move in a second direction opposite to the first direction toward the discharge unit flow path to connect the suction unit flow path and the compression unit flow path, and wherein the valve comprises:

a first compression unit compressed by the suction pressure of the suction unit, a second compression unit compressed by the discharge pressure of the discharge unit, the second compression unit being formed on an opposite side to the first compression unit in a moving direction of the valve, and an opening unit configured to open and close the compression unit flow path.

2. The compressor of claim 1, wherein the valve opens the bypass flow path when the difference between the discharge pressure of the discharge unit and the suction pressure of the suction unit is less than a predetermined pressure, and closes the bypass flow path when the difference between the discharge pressure of the discharge unit and the suction pressure of the suction unit is larger than the predetermined pressure.

3. The compressor of claim 1, wherein the elastic member is configured to bias the valve in an elastic manner so that the valve opens the bypass flow path.

4. The compressor of claim 3, wherein the elastic member comprises a coil spring.

5. The compressor of claim 3, wherein the fixed scroll comprises an elastic member supporting unit configured to support one end of the elastic member.

6. The compressor of claim 5, wherein an other end of the elastic member is supported by the valve.

7. The compressor of claim 1, wherein the compression unit flow path includes a first portion disposed in the fixed scroll and a second portion having an opening that faces toward a second side of the valve in a third direction that is perpendicular to the first direction.

8. The compressor of claim 1, wherein the fixed scroll comprises a plate unit having a wrap unit extended toward a lower side and a valve housing coupled to an upper surface of the plate unit, and the cylinder space is formed inside the valve housing.

9. The compressor of claim 1, wherein the fixed scroll comprises a plate unit having a wrap unit extended toward a lower side and a valve housing coupled to an upper surface of the plate unit, and the cylinder space is formed inside the valve housing.

10. The compressor of claim 9, wherein the valve housing comprises:

a bottom housing coupled to an upper surface of the plate unit and configured to form a part of the cylinder space, an intermediate housing coupled to the bottom housing and configured to form a remaining part of the cylinder space, and a cover housing coupled to the intermediate housing and provided with the discharge unit flow path configured to connect the cylinder space to the discharge unit.

11. The compressor of claim 1, wherein the fixed scroll comprises a plate unit having a wrap unit extended toward a lower side and a valve housing coupled to an upper surface of the plate unit, and a part of the cylinder space is formed in the plate unit and a remaining part of the cylinder space is formed inside the valve housing.

12. The compressor of claim 1, wherein the valve comprises a cylindrical shape.

13. The compressor of claim 1, wherein the valve comprises a spherical shape.

14. The compressor of claim 1, wherein the valve is provided to be movable back and forth in a vertical direction in the cylinder space.

15. The compressor of claim 1, wherein the valve is provided to be movable back and forth in a horizontal direction in the cylinder space.

16. A compressor, comprising:

a case;

a fixed scroll fixed to an inside of the case;

an orbiting scroll provided to move about the fixed scroll and configured to form a suction unit and a compression unit with the fixed scroll;

a discharge unit to which a refrigerant compressed by the compression unit is discharged;

a cylinder space provided in the fixed scroll;

a suction unit flow path configured to connect the cylinder space to the suction unit;

a compression unit flow path configured to connect the cylinder space to the compression unit;

a discharge unit flow path configured to directly connect the cylinder space to the discharge unit;

a valve disposed to be movable in the cylinder space and configured to connect and disconnect the suction unit flow path from the compression unit flow path according to a difference between a discharge pressure of the discharge unit and a suction pressure of the suction unit; and an elastic member provided in the cylinder space to elastically support the valve, wherein a leading surface of the valve is configured to move in a first direction perpendicular to the leading surface of the valve toward the suction unit flow path to disconnect the suction unit flow path from the compression unit flow path and to move in a second direction opposite to the first direction toward the discharge unit flow path to connect the suction unit flow path and the compression unit flow path, and wherein the valve comprises:

a first compression unit compressed by the suction pressure of the suction unit, a second compression unit compressed by the discharge pressure of the discharge unit and formed on an opposite side to the first compression unit in a moving direction of the valve, and an opening unit configured to open and close the compression unit flow path.

17. A compressor, comprising:

a fixed scroll;

an orbiting scroll provided to move about the fixed scroll;

a compression unit formed by the fixed scroll and the orbiting scroll;

a suction unit configured to suction a refrigerant to be delivered to the compression unit so that the compression unit compresses the refrigerant delivered to the compression unit; and a discharge unit to which the refrigerant compressed by the compression unit is discharged;

a cylinder space provided in the fixed scroll;

a valve disposed in the cylinder space and configured to control a flow path between the suction unit and the compression unit by moving in a first direction perpendicular to a leading surface of the valve when a difference between a discharge pressure of the discharge unit and a suction pressure of the suction unit is less than a predetermined pressure, and by moving in a second direction opposite to the first direction when the difference between the discharge pressure of the discharge unit and the suction pressure of the suction unit is greater than the predetermined pressure;

a discharge unit flow path configured to directly connect the cylinder space to the discharge unit; and an elastic member configured to elastically support the valve, wherein the leading surface of the valve is configured to move in the first direction perpendicular to the leading surface of the valve toward the suction unit to disconnect the flow path between the suction unit and the compression unit and to move in the second direction toward the discharge unit flow path to connect the suction unit flow path and the compression unit flow path, and wherein the valve comprises:

a first compression unit compressed by the suction pressure of the suction unit, a second compression unit compressed by the discharge pressure of the discharge unit and formed on an opposite side to the first compression unit in a moving direction of the valve, and an opening unit configured to open and close the compression unit flow path.

* * * * *